United States Patent [19]

Nakajima et al.

[11] 4,121,064

[45] Oct. 17, 1978

[54] IGNITION DISTRIBUTOR HAVING INDEPENDENT IGNITION SYSTEM BREAKER ARM CONTACTS SIMULTANEOUSLY ENGAGING COMMON CONDUCTIVE POST

[75] Inventors: Yasuo Nakajima, Yokosuka; Yoshimasa Hayashi, Yokohama; Makio Waku, Urawa, all of Japan

[73] Assignee: Nissan Motor Company, Limited, Yokohama, Japan

[21] Appl. No.: 776,213

[22] Filed: Mar. 10, 1977

[30] Foreign Application Priority Data

Mar. 11, 1976 [JP] Japan ..... 51/28870[U]

[51] Int. Cl.[2] ..... H01H 19/00

[52] U.S. Cl. ..... 200/19 A; 200/21; 200/27 A; 200/30 A

[58] Field of Search ..... 200/19 R, 19 A, 19 DC, 200/19 DR, 20, 21, 22, 27 A, 30 R, 30 A, 31 R, 31 A, 31 DP, 31 V, 31 CA, 153 LB; 123/146.5 R, 146.5 A, 148 R, 148 DC, 148 DS

[56] References Cited

U.S. PATENT DOCUMENTS

| | | | |
|---|---|---|---|
| 1,262,544 | 4/1918 | Moses | 200/21 |
| 1,306,116 | 6/1919 | Moses | 200/21 |
| 1,568,112 | 1/1926 | Voge | 200/27 A |
| 2,150,206 | 3/1939 | Crocker | 200/30 A |
| 2,290,078 | 7/1942 | Thomas | 200/30 AA |
| 2,697,762 | 12/1954 | Burch | 200/27 A X |
| 2,854,534 | 9/1958 | Beauclair | 200/27 A X |
| 2,987,589 | 6/1961 | Mallory, Jr. | 200/27 A X |
| 3,604,864 | 9/1971 | Habert | 200/31 A X |

*Primary Examiner*—James R. Scott
*Attorney, Agent, or Firm*—Bacon & Thomas

[57] ABSTRACT

Two sets of breaker contacts respectively associated with independent ignition systems have two breaker arms with identical configuration, arranged coaxially one above the other to engage a cam at an identical angular position thereof whereby the contacts open and close synchronously.

2 Claims, 4 Drawing Figures

IGNITION DISTRIBUTOR HAVING INDEPENDENT IGNITION SYSTEM BREAKER ARM CONTACTS SIMULTANEOUSLY ENGAGING COMMON CONDUCTIVE POST

BACKGROUND OF THE INVENTION

The present invention relates to an ignition distributor for an automotive internal combustion engine of the type having two spark plugs for each engine cylinder and means for recirculating the exhaust gases into the mixture supply system of the engine at a controlled rate.

In some present day automotive internal combustion engines, arrangements are made so that the exhaust gases emitted from the exhaust ports of the engine are recirculated into the mixture supply systems of the engines at controlled rates. This is effective to properly reduce the maximum temperatures and pressures of the combusted gases in the engine cylinders and to thereby reduce the concentrations of nitrogen oxides in the exhaust gases emitted from the engine. If, in this instance, the exhaust gases from the engine cylinders are recirculated into the mixture supply system at an excessively high rate, the performance characteristics of the engine are impaired and would give rise to increases in the concentrations of other air contaminative compounds such as hydrocarbons and carbon monoxide contained in the exhaust gases. For this reason, it has been an ordinary practice to have the exhaust gases recirculated at a rate which is varied within a predetermined range. For the purpose of reducing the concentrations of nitrogen oxides in the engine exhaust gases to a satisfactory extent, however, it is desired to have the exhaust gases recirculated at a higher rate.

It has therefore been proposed that an internal combustion engine of the type having two spark plugs for each of its cylinders and means for recirculating the exhaust gases into the mixture supply system of the engine at a controlled rate. In this engine with such arrangements, the compressed air-fuel mixture in each combustion chamber is ignited by two sparks so that flame fronts propagate radially inwardly from the vicinities of the inner peripheral surface of the cylinder defining the combustion chamber during combustion strokes. The distance of travel of each flame fronts from the spark plugs is therefore made far shorter than the distance of travel of the flame from a single spark plug in an ordinary internal combustion engine and, as a consequence, the combustion in each cycle of operation of the cylinder is terminated earlier than that occurring in an ordinary engine. This permits the engine to operate properly without impairing the performance characteristics of same while utilizing an exhaust gas recirculation rate (the volumetric proportion of the quantity of the recirculated exhaust gases versus the quantity of fresh air in an air-fuel mixture) selected from the range upper limit of which is 25 to 40%.

In the engine of the type discussed before, it is desirable for the purpose of achieving the shortest combustion time, which provides the most efficient and stable operation of the engine, to arrange two spark plugs diametrically opposed and equidistant from the cylinder axis and to control the two spark plugs in such a manner that sparks are generated by the spark plugs at exactly the same instant or without any phase difference.

For attaining such desirable control of the two spark plugs which are respectively associated with independent ignition systems, an ignition distributor mounted on the engine of the foregoing type, also known in the art as a twin ignition distributor, has conventionally been constructed as shown in FIG. 1. In this conventional ignition distributor 10, a cam 12 is formed, only for illustration, as a square cam (for a four-cylinder engine) and breaker arms 14 and 16 are arranged on an identical plane normal to the axial direction of the cam 12 to have symmetrical or equidistantly opposed locations with respect to the cam 12. Two contact supports 13 and 15 are also arranged to have symmetrical locations with respect to the cam to cooperate with the breaker arms. The breaker arms 14 and 16 are also adapted to engage with the cam 12 at diametrically opposed angular positions thereof as shown so that the breaker arms may synchronously swing around pivot posts 18 and 20 actuated by the opposingly located lobes 22 and 24 or 26 and 28 respectively whereby breaker contacts 30 and 32 are opened and closed in synchronous timing.

This conventional distributor, however, encounters a drawback that the synchronous operation of the breaker contacts depends on the accuracy of the symmetrical arrangement of the breaker arms and contact supports, which results in poor productivity of the ignition distributor particularly in its assembly, and also depends on the accuracy of the cam particularly with respect to the symmetrical locations of the lobes, which results in the non-synchronous operation of the breaker contacts since the completely symmetrical location of the lobes are practically impossible to be fabricated.

It is accordingly an object of the present invention to provide an ignition distributor for an automotive internal combustion engine of the foregoing type which is free from the aforementioned drawback inherent in the conventional ignition distributor for the same use.

BRIEF DESCRIPTION OF THE DRAWINGS

This and other objects and advantages of the present invention will become more apparent from the following description in conjunction with the accompanying drawings, in which.

DESCRIPTION OF A PREFERRED EMBODIMENT

Figure 1:
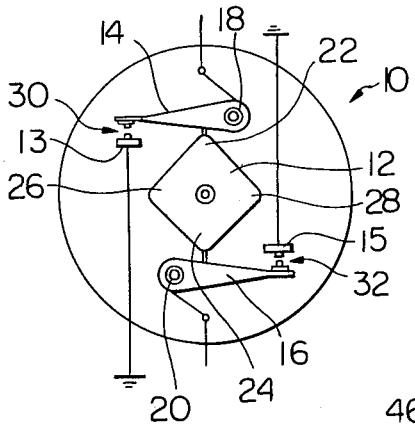
Fig. 1 PRIOR ART
FIG. 1 is a diagrammatic plan view of a conventional twin ignition distributor.
Figure 2:
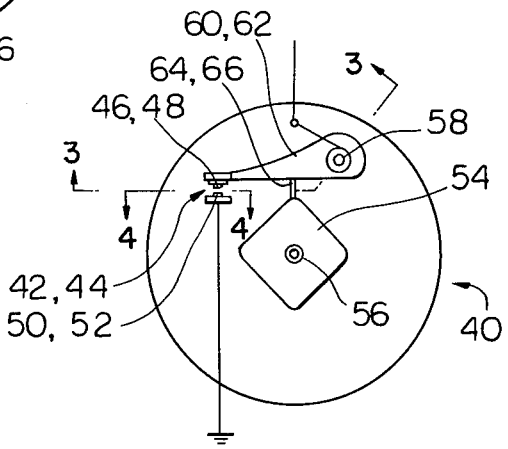
FIG. 2 is a diagrammatic plan view of a twin ignition distributor according to the present invention.
Figure 3:
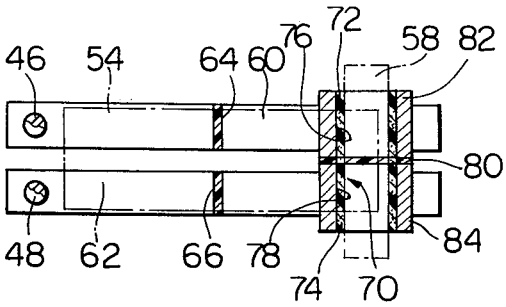
FIG. 3 is a schematic sectional view taken along the line of 3—3 in FIG. 2.
Figure 4:
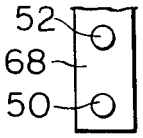
FIG. 4 is a schematic elevation view of a contact support of the twin ignition distributor according to the present invention taken along the line 4—4 in FIG. 2.

Referring to FIGS. 2 to 4, a twin ignition distributor 40 according to the present invention comprises two sets of breaker contacts 42 and 44 each of which is composed of a movable contact 46 and 48 connected to a primary side of an ignition coil of an independent ignition system (not shown) and a stationary contact 50 or 52 connected to the ground. A cam 54 is carried on a distributor drive shaft 56 which is driven in timed relation with the engine (not shown) so that the cam is driven to rotate around an axis thereof in timed relation with the engine. The cam 54 is formed, only for example, as a square cam which has four lobes for use with a four-cylinder engine. A pivot post 58 is arranged to have an axis substantially parallel to the axis of the cam 54. Two breaker arms 60 and 62 are coaxially mounted on the pivot post 58 one above the other or in a stack and are arranged to be in engagement with the cam 54 at an identical angular or circumferential position thereof. For such arrangements of the breaker arms, the breaker arms are constructed to have an identical configuration. The breaker arms 60 and 62 are respectively provided with followers or rubbing blocks 64 and 66 which are therefore identical in shape to each other and are arranged in the corresponding locations thereof. The aforementioned movable contacts 46 and 48 are attached to the respective breaker arms 60 and 62 and are located thereon correspondingly. The stationary contacts 50 and 52 are preferably arranged on a common contact support 68 as best seen in FIG. 4. The common contact support provides increased accuracy in assembling the stationary contacts into the ignition distributor, however, independent contacts supports (not shown) are also available in lieu thereof, if desired.

As best seen in FIG. 3, the twin ignitiion distributor 40 according to the present invention further includes an insulation means 70 for electrical insulation between the two sets of breaker contacts 42 and 44. The insulation means 70 is composed of two insulation bushings 72 and 74 which are respectively inserted into openings 76 and 78 in the breaker arms 60 and 62 for providing insulation between the two breaker arms and the pivot post, and an insulation washer 80 which is disposed between the mating portions 82 and 84 of the two breaker arms for the insulation therebetween.

With these constructions and arrangements, it will be appreciated that the twin ignition distributor according to the present invention is free from the drawback inherent in the conventional twin ignition distributor, because on one common pivot post mounted are two breaker arms in the twin ignition distributor according to the present invention, as compared to two independent pivot posts in the conventional twin ignition distributor. Further because on a common contact support arranged preferably are movable contacts in the twin ignition distributor according to the present invention, while on independent contact supports disposed spaced from each other in the conventional twin ignition distributor. Still further because the breaker arms 60 and 62 are adapted to engage with the cam 54 at an identical angular position thereof, in other words, the breaker arms are actuated by an identical lobe of the cam, the synchronous operation of the breaker contacts of the twin ignition distributor according to the present invention is independent of the accuracy of symmetrical locations of the breaker arms and contact supports and the accuracy of the cam. viz., the accuracy of the symmetrical locations of the lobes.

From the foregoing description, it will be appreciated that the twin ignition distributor according to the present invention is quite effective in providing optimally efficient combustion characteristics of the automotive internal combustion engine of the type having two spark plugs for each engine cylinder and means for recirculating the exhaust gases into the mixture supply system of the engine.

What is claimed is:

1. An ignition distributor for an internal combustion engine of the type having two spark plugs in each cylinder and means for recirculating a portion of the exhaust gases to an intake system of the engine, said two spark plugs being energized at the same ignition timing through first and second independent ignition systems, comprising:

a first set of breaker contacts for connection to said first independent ignition system;

a second set of breaker contacts for connection to said second independent ignition system;

a cam driven to rotate around an axis thereof in timed relation with the engine;

a pivot post parallelly off-set from the axis of said cam;

a first breaker arm mounted on said pivot post;

a second breaker arm mounted on said pivot post above said first breaker arm;

a pair of insulating bushings each of which is mounted on one of said breaker arms to insulate each of said breaker arms from said pivot post; and an insulating washer mounted on said pivot post and interposed between said first and second breaker arms for insulation between said breaker arms, in which said breaker arms are of an identical configuration thereby to engage said cam at an identical angular position thereof such that upon rotation of said cam, said first and second sets of breaker contacts open and close at exactly the same instant to produce the same ignition timing.

2. In an internal combustion engine having at least one combustion chamber, two spark plugs disposed in the combustion chamber, a first and a second independent ignition system each of which is connected to one of said spark plugs, for energizing said spark plugs at the same ignition timing, an intake system for supplying therethrough a mixture of air and fuel to the combustion chamber, an exhaust system for discharging therethrough the exhaust gases emitted from the combustion chamber and an exhaust gas recirculation system for recirculating a portion of the exhaust gases from the exhaust system to the intake system, an ignition distributor comprising:

a pair of spaced apart fixed contacts;

a cam driven to rotate around an axis thereof in timed relation with the engine and having an axially uniform periphery;

a pivot post parallelly off-set from the axis of said cam;

first and second breaker arms mounted on said pivot post one above the other and each having a contact engaging one of said fixed contacts, each of said breaker arms also having a rubbing block engaged by said cam for pivoting each of said breaker arms away from one of said fixed contacts;

said fixed contacts and the contacts of said breaker arms constituting two sets of breaker contacts respectively connected to a different one of said independent ignition systems;

a pair of insulating bushings each of which is mounted on one of said breaker arms to insulate each of said breaker arms from pivot post; and an insulating washer mounted on said pivot post and interposed between said first and second breaker arms for insulation between said breaker arms, in which said breaker arms are of an identical configuration so that said rubbing blocks engage the periphery of said cam at a circumferentially identical position thereof such that upon rotation of said cam, said two sets of breaker contacts open and close at exactly the same instant to produce the said same ignition timing.

* * * * *